US009775216B2

(12) United States Patent
Szczerba et al.

(10) Patent No.: US 9,775,216 B2
(45) Date of Patent: Sep. 26, 2017

(54) METHOD OF CONTROLLING A LIGHTING DEVICE

(71) Applicant: PHILIPS LIGHTING HOLDING B.V., Eindhoven (NL)

(72) Inventors: Marek Zbigniew Szczerba, Eindhoven (NL); Franciscus Laurentius Van Boekhout, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/412,911

(22) PCT Filed: Jul. 5, 2013

(86) PCT No.: PCT/IB2013/055520
§ 371 (c)(1),
(2) Date: Jan. 5, 2015

(87) PCT Pub. No.: WO2014/009861
PCT Pub. Date: Jan. 16, 2014

(65) Prior Publication Data

US 2015/0195888 A1 Jul. 9, 2015

Related U.S. Application Data

(60) Provisional application No. 61/669,163, filed on Jul. 9, 2012.

(51) Int. Cl.
*H05B 37/02* (2006.01)
*H05B 33/08* (2006.01)
(Continued)

(52) U.S. Cl.
CPC ..... *H05B 37/0209* (2013.01); *H05B 33/0845* (2013.01); *H05B 37/0245* (2013.01); *H05B 39/044* (2013.01); *H05B 41/39* (2013.01)

(58) Field of Classification Search
CPC H05B 41/38; H05B 41/2886; H05B 41/3921; H05B 41/2882; H05B 37/0254;
(Continued)

(56) References Cited

U.S. PATENT DOCUMENTS 6,040,661 A 3/2000 Bogdan
6,486,616 B1 * 11/2002 Liu ..... H05B 41/3921 315/209 R
(Continued)

FOREIGN PATENT DOCUMENTS

CA 2725191 A1 4/2011
CN 1419800 A 5/2003
(Continued)

*Primary Examiner* — Alexander H Taningco
*Assistant Examiner* — Renan Luque

(57) ABSTRACT

According to an aspect of the invention, a method of controlling a lighting device is provided. The method comprises receiving an input from a dimmer, the input being representative of a desired light output level for the lighting device. A control voltage for operating a driver unit comprised in the lighting device is computed based on the input and a calibrated relationship between power consumption and control voltage for the lighting device.

13 Claims, 2 Drawing Sheets

(51) Int. Cl.
*H05B 39/04* (2006.01)
*H05B 41/39* (2006.01)

(58) Field of Classification Search
CPC .... H05B 41/36; H05B 41/3928; H05B 41/42; H05B 41/3922
USPC ..... 315/291, 307, 209, 224, 308, 294
See application file for complete search history.

(56) References Cited

U.S. PATENT DOCUMENTS

| | | | | |
|---|---|---|---|---|
| 2004/0183473 | A1* | 9/2004 | Kamoi et al. | 315/291 |
| 2006/0181222 | A1* | 8/2006 | Deurloo | H05B 41/3928 315/209 R |
| 2007/0170873 | A1* | 7/2007 | Mishima | H05B 41/2886 315/291 |
| 2008/0197300 | A1 | 8/2008 | Kayser | |
| 2010/0060201 | A1* | 3/2010 | Lee | H05B 41/38 315/307 |
| 2010/0102747 | A1* | 4/2010 | Ilyes et al. | 315/291 |
| 2011/0074302 | A1* | 3/2011 | Draper | H05B 41/3924 315/224 |
| 2013/0200807 | A1* | 8/2013 | Mohan | H05B 37/02 315/151 |

FOREIGN PATENT DOCUMENTS

| | | | |
|---|---|---|---|
| CN | 1939100 | A | 3/2007 |
| CN | 101502180 | A | 8/2009 |
| CN | 102077694 | A | 5/2011 |
| EP | 1128711 | A2 | 8/2001 |
| EP | 1729549 | A1 | 12/2006 |
| EP | 2375860 | A2 | 10/2011 |
| JP | 2003133085 | A | 5/2003 |
| WO | 03101151 | A2 | 12/2003 |

* cited by examiner

METHOD OF CONTROLLING A LIGHTING DEVICE

CROSS-REFERENCE TO PRIOR APPLICATIONS

This application is the U.S. National Phase application under 35 U.S.C. §371 of International Application No. PCT/IB2013/055520, filed on Jul. 5, 2013, which claims the benefit of U.S. Provisional Patent Application No. 61/669,163, filed on Jul. 9, 2012. These applications are hereby incorporated by reference herein.

FIELD OF THE INVENTION

The present invention generally relates to the field of light output control for dimming-based lighting devices.

BACKGROUND OF THE INVENTION

Lighting devices are often connected to dimmers (light control units) to provide control over the intensity of light emitted from the lighting devices. When light intensity is to be adjusted, a light control unit typically receives a (relative) light input level. This input is frequently in terms of a light level percentage of a maximum light level. This (relative) light input level is then converted into an analogue control voltage by the light control unit. The control unit utilizes a linear approximation of a dim curve, generally expressed as $y=ax+b$, where y is the relative light level, x is the control voltage, and a and b are constant values, to determine the control voltage that matches the received light input level. To establish this linear approximation, the light control unit typically derives parameters defining e.g. slope and intersection with the y axis from predetermined data in a "lamp type file". The linear approximation is generally made such as to match the driver dim curve as closely as possible. The analogue control voltage derived from the above mentioned approximation is converted into a (relative) light output level by the dimming driver and lamp of the lighting device.

SUMMARY OF THE INVENTION

It is an object of the present invention to provide improved control of light output from dimming-based lighting devices.

This and other objects are achieved by a method, a control unit and a lighting device as defined by the independent claims. Embodiments of the invention are defined by the dependent claims.

According to one aspect of the invention, a method of controlling a lighting device is provided. The method comprises receiving an input from a dimmer, the input being representative of desired light output level for the lighting device. A control voltage for a driver unit comprised in the lighting device is computed, for thereby operating a light source used in the lighting device based on the input so as to provide the desired light output level, wherein the computing is at least partly based on a calibrated relationship between power consumption and control voltage for the lighting device.

The present invention provides a method of controlling a lighting device such that the light output from the lighting device more closely corresponds to a desired light level. Conventional methods of controlling light output from lighting devices often rely on distributing control voltages calculated from linear approximations of dimming control characteristics. These linear approximations however frequently result in a discrepancy between a desired light level and an actual light (output) level due to non-linearity of the driver dim curve, i.e. the actual dim curve. The present invention is instead based on the insight that power consumption of the lighting device is more closely correlated to the light output level than the linearly approximated control voltage. Thus, instead of using a linear approximation for finding the control voltage representative of a desired light level, the present invention uses a calibrated relationship between the power consumption and the control voltage for (automatically) determining the required control voltage.

The input received in the present invention is representative of a desired light output level, which for example may be expressed in percentage of a maximum light output level.

According to the present invention, if the input indicates a light output level of x %, the control voltage for driving the lighting device is computed from a calibrated relationship such that it provides a power consumption of x % of the maximum power consumption or required light output level of the lighting device.

In an embodiment of the present invention, the calibrated relationship may be represented by (or implemented in) a lookup table. A lookup table, or dimming table, may comprise the dimming control characteristics for a particular lighting device. For example, a minimum dimming level, corresponding to the lowest possible control voltage for the particular lighting device and driver, and a maximum lighting level, corresponding to the highest possible control voltage, may be derived from a lookup table. The lookup table provides the control voltage necessary for, for instance, achieving a required output light level as defined by the input.

In another embodiment of the present invention, the calibrated relationship may be represented by a dim curve. The dim curve representing the calibrated relationship more closely corresponds to the actual driver dim curve, and thus may allow a more accurate control of output light. In another embodiment of the present invention, the calibrated relationship may be established by measuring power consumption for various control voltage values. This calibration may for example be carried out only once, e.g. during installation of a lighting device, or repeatedly at random or defined time intervals to ensure accurate output light levels during the entire lifetime of a particular lighting device. From the measured values, a lookup table or a dim curve may be created.

By utilizing a calibrated relationship, the present invention eliminates the need for importing a lamp type file holding dimming control characteristics, i.e. slope and y intercept of the linearized dim curve. In practice, managing lamp type files and their distribution to lighting devices is often cumbersome.

In another embodiment of the present invention, the measured values of the calibrated relationship may be stored. Storing may for example take place in a non-volatile memory of a light control unit. If calibration is performed at certain time intervals, storing of the values may allow for analysis (and comparison) of the dimming characteristics of a lighting device over time. In addition, the stored values may be transmitted to a segment control unit, responsible for controlling a plurality of lighting devices, for e.g. monitoring purposes.

In another embodiment, the measured values of the calibrated relationship, i.e. the measured power consumption and control voltages, may be analyzed to establish a dim curve. In other words, the measured power consumption is analyzed as a function of the control voltage values. In this way, dimming characteristics such as minimum dimming level and maximum control values may be determined.

In another embodiment, the measured power consumption may be further analyzed to determine the type of a light source used in the lighting device. The type of light source may be determined by analyzing power consumption versus control level ratio, where control level for example follows the following sequence: first, the lamp (or light source) is warmed up for a couple of minutes (e.g. 5 minutes). Second, the lamp is dimmed down gradually. When the dim level reaches the minimum dimming level for the lamp, the lamp will turn off, causing an abrupt decrease in power consumption. The lamp type may thus be determined by analyzing the correlation between power consumption while warming up, the relation between control input level and power consumption and the minimum dimming level reached. Certain lamp types (e.g. incandescent, LED) allow dimming down to 0%, whereas other lamp types (e.g. HID) allow only very limited dimming. In addition, power consumption versus light output level may be further analyzed in order to fine-tune the calibrated relationship between power consumption and control voltage.

In another embodiment, further analysis of the measured power consumption may be carried out in order to determine warm-up time and life expectancy of a light source used in the lighting device. For instance, in the case of discharge lamps, power consumption will stabilize after a few minutes once the light source is turned on. Contrary to this, in case of LED lamps, power consumption stabilizes very quickly. The time required for stabilization and the eventually measured power consumption values can be used to determine a lamp type which in turn might be used to estimate life expectancy. This information may be useful for improved control of lighting devices. For example, if power consumption varies over time, it may be advantageous to only revise, or adjust, the control voltage from its maximum level after the warm-up time, in particular in systems comprising several lighting devices where specific light paths need to be achieved. Furthermore, from a safety perspective, estimation of life expectancy or life time of a light source may prove valuable in that it provides information on when to change a particular light source or lamp.

In another embodiment, a light source used in the lighting device may be selected from the group consisting of light emitting diode (LED), high pressure sodium, metal-halide and fluorescent light sources.

In another embodiment, the control voltage value(s) may be between 0 and 10 V or between 1 and 10 V. This may be accomplished with a dimming driver using a 0-10 V or a 1-10 V protocol.

It should be understood that the embodiments disclosed above may be freely combined unless stated otherwise. The embodiments disclosed as applicable to the present invention should further be interpreted as equally applicable to all aspects of the invention. In particular, the specific embodiments disclosed above in relation to the method aspect, are also relevant for the following further aspects of the invention.

In another aspect of the present invention, there is provided a control unit for a lighting device, the control unit being configured to receive an input from a dimmer, the input being representative of a desired light output level for the lighting device, and to compute a control voltage for a driver unit comprised in the lighting device, for thereby operating a light source used in the lighting device based on the input so as to provide the desired light output level, wherein the computing is at least partly based on a calibrated relationship between power consumption and control voltage for the lighting device.

In another aspect of the present invention, there is provided a lighting device comprising a control unit as defined above, a driver unit and a power measurement unit. As outlined above, the control unit is configured to receive an input from a dimmer and to compute a control voltage corresponding to the received input. The control unit is further configured to transmit the computed control voltage to the driver unit, which in turn is configured to operate a light source used in the lighting device so as to provide the desired light output level. The power measurement unit is configured to measure power consumed by at least one of a light source used in the lighting device and/or the driver unit during operation of the lighting device. Measured power consumption is transmitted to the control unit for establishing the relationship between power consumption and control voltage.

The lighting device may for example be part of an indoor or outdoor lighting system. When the lighting device is part of an outdoor lighting system, the control unit comprised in the device may be an Outdoor Luminaire Controller (OLC). The driver unit may be a 0-10 V or 1-10 V dimming driver, such as an electronic voltage regulated dimming driver using a 0-10 V or 1-10 V protocol. The dimmer may be part of a Segment Controller (SC), which is responsible for controlling a plurality of lighting devices, or it may be comprised in the lighting device itself.

It is noted that the invention relates to all possible combinations of features recited in the claims. Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

This and other aspects of the present invention will now be described in more detail, with reference to the appended drawings showing embodiments of the invention.

The figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
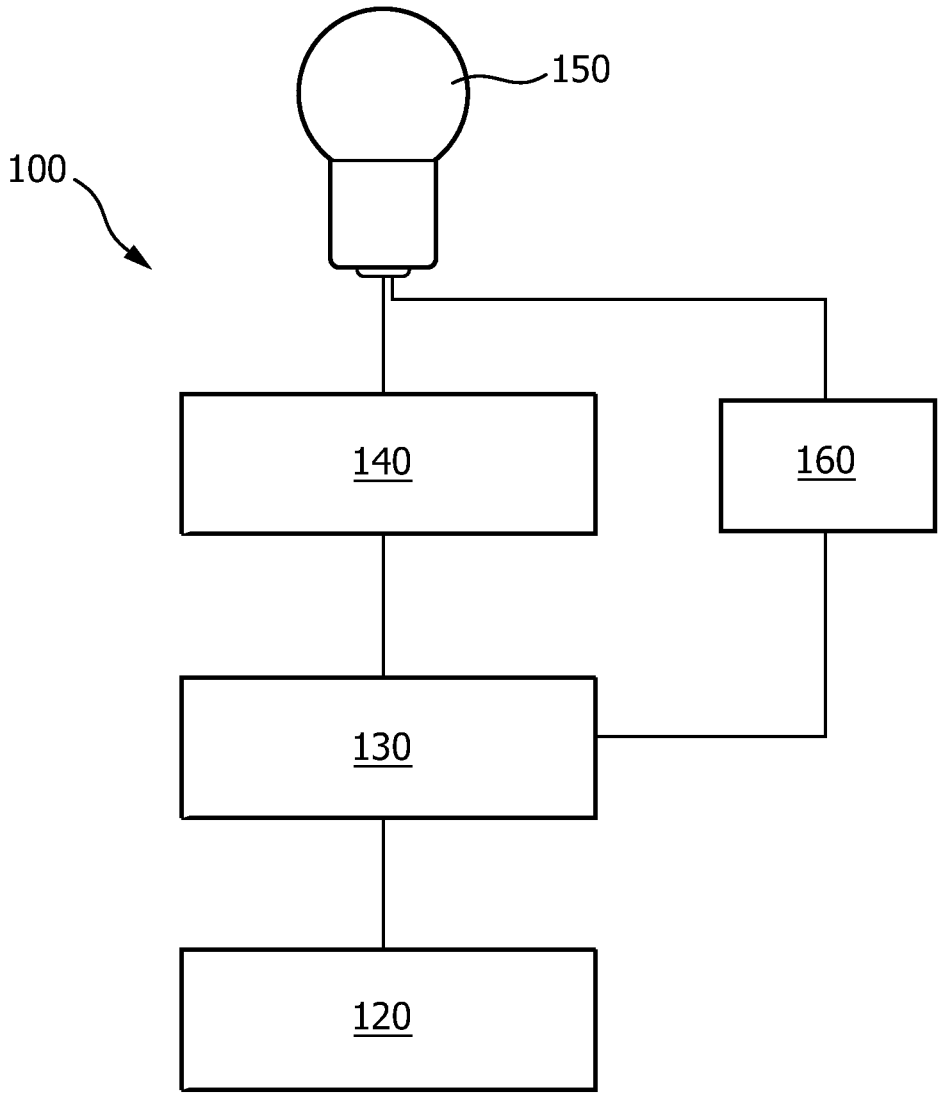
FIG. 1 is a schematic representation of an embodiment of a lighting device according to the invention.
Figure 2:
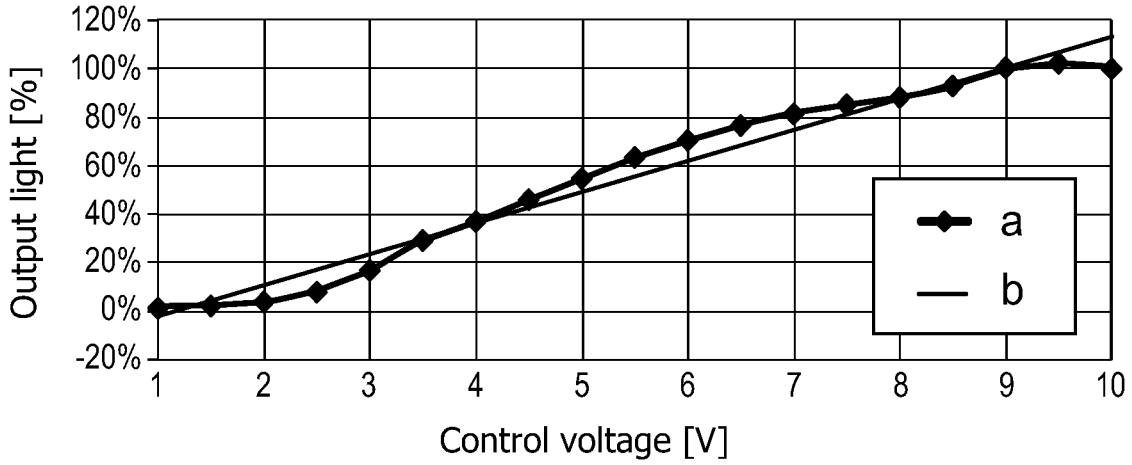
FIG. 2 is a graphic representation showing an (exemplary) actual driver dim curve and an (exemplary) linearly approximated dim curve.
Figure 3:
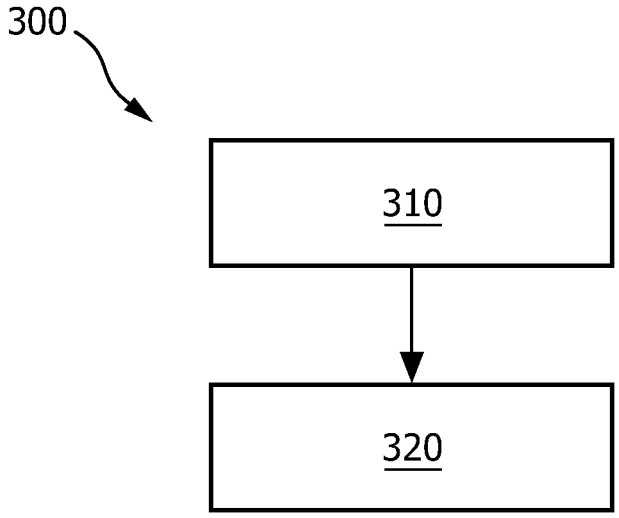
FIG. 3 is an outline of a method of controlling a lighting device according to an embodiment of the present invention.

With reference to FIGS. 1-3, a lighting device according to an embodiment of the present invention will be described.

FIG. 1 schematically represents a lighting device 100 according to an embodiment of the present invention. The lighting device 100 comprises a dimmer 120, a control unit 130, a driver unit 140, a light source 150 such as a lamp, and a power measurement unit 160. It is here to be understood that in other embodiments the dimmer 120 need not be comprised in the lighting device 100, and instead may be comprised in a separate controller responsible for controlling a plurality of lighting devices (not shown).

Control unit 130 receives at step 310 (of FIG. 3) an input representative of a desired light output level from dimmer 120. The input may be in terms of % light level of a maximum light level. The control unit 130 is for example an Outdoor Luminaire Controller (OLC). Based on a calibrated relationship, which will be described in further detail below, the control unit 130 determines at step 320 the control voltage corresponding to the input, generally representing a desired light output level. The computed control voltage is applied to a driver unit 140, such as an electronic 0-10 V or 1-10 V dimming driver. The driver unit converts the control voltage into a drive signal for the lamp 150 in order to adjust the light intensity to the desired light output level. Power measurement unit 160 measures the power consumed by the lamp 150 and/or the power consumed by the driver unit 140 and provides the resulting measured values to the control unit 130.

In the graphic representation that is FIG. 2, exemplary dim curves are shown. The linear curve denoted "b" represents a linear approximation of light output (y axis) as a function of control voltage (x axis), which is common in prior art control units. The linear approximation is based on dimming characteristics comprised in a lamp type file which has to be distributed to the control unit. The dimming characteristics of the lamp type file typically define a minimum dimming level and a maximum control voltage.

Even if the linear approximation resulting from the interpolation between e.g. a minimum value and a maximum value is defined in order to match the actual driver dim curve as closely as possible, there is frequently a discrepancy at certain points. In this example, the actual driver dim curve denoted "a" (black squares) differs from the linear curve denoted "b" e.g. at 2 V and at 6 V. Further, the control voltage saturates at 9 V. This means that when the light input level is e.g. 60%, the control unit's task is to provide a control voltage corresponding to this desired light level. To accomplish this, a prior art control unit utilizes the linear dim curve denoted "b" resulting in a required control voltage of 6 V. A control voltage of 6 V will, however, based on the actual dim curve of the driver, result in a dimming level of 70% instead of the correct level of 60%.

In the present embodiment, a control voltage for operating the lighting device is computed based on the input and a calibrated relationship between power consumption and control voltage for the lighting device such that the computed control voltage corresponds to the input. An exemplary method of defining a calibrated relationship between power consumption and control voltage is described below.

During e.g. installation (commissioning phase) of a lighting device, a control unit performs a series of power consumption measurements (absolute or relative) for various control voltages. An exemplary output of such measurements is given in the table below.

TABLE 1

| Exemplary output of power measurements | | | | | | | | | | |
|---|---|---|---|---|---|---|---|---|---|---|
| | Control Voltage [V] | | | | | | | | | |
| | 1 | 2 | 3 | 4 | 5 | 6 | 7 | 8 | 9 | 10 |
| Power value [%] | 60 | 60 | 65 | 70 | 75 | 80 | 85 | 100 | 100 | 100 |

In this example, power consumption is measured for each control voltage integer between 1 and 10 V. Depending on the protocol of the dimming driver, power measurements may be performed for other ranges of control voltages. The number of power measurements performed within the control voltage range moreover influences dimming resolution. In practice, power measurements may be performed at every 1 V or at every 0.5 V.

Based on the measured power consumption presented in Table 1, the control unit determines the minimum dimming level (in this case 60%) and generates a dimming table, i.e. a lookup table. In this particular case such a table would be as follows:

TABLE 2

| Lookup table | | | | | | | | | | |
|---|---|---|---|---|---|---|---|---|---|---|
| | Power value [%] (or Light level [%]) | | | | | | | | | |
| | 10 | 20 | 30 | 40 | 50 | 60 | 70 | 80 | 90 | 100 |
| Control voltage [V] | — | — | — | — | — | 2 | 4 | 6 | 7.5 | 8 |

In the lookup table, power consumption values or, according to embodiments of the invention, light levels may be presented for various control voltages.

Once the calibrated relationship is established, dimming can be controlled by providing e.g. a required light output level percentage. The actual control voltage is determined using the dimming table. In order to fine tune the relationship between light output level and control voltage, linear interpolation can be used between sampled levels.

The person skilled in the art realizes that the present invention by no means is limited to the preferred embodiments described above. On the contrary, many modifications and variations are possible within the scope of the appended claims. It should be noted that the above-mentioned embodiments illustrate rather than limit the invention and that those skilled in the art will be able to design alternative embodiments without departing from the scope of the appended claims. In the claims, any reference signs placed between parentheses shall not be constructed as limiting the claim. The word "comprising" does not exclude the presence of elements or steps not listed in a claim. The word "a" or "an" preceding an element does not exclude the presence of a plurality of such elements. No specific sequence of acts is intended to be required unless specifically indicated.

The invention claimed is:

1. A method of controlling a lighting device having a commissioning and operating phase, comprising:

receiving, during the commissioning phase, an input from a dimmer, said input being representative of desired light output level for said lighting device, and computing, during the commissioning phase, a control voltage for a driver unit comprised in said lighting device, for thereby operating a light source used in said lighting device based on said input so as to provide said desired light output level, wherein said computing is at least partly based on an earlier established calibrated relationship between power consumption and control voltage for said lighting device by measuring power consumption values obtained from applying various control voltage values; whereby light output levels are determined that correspond to said various control voltage values and the control voltage is available during the operating phase.

2. A method according to claim 1, wherein said calibrated relationship is represented by a lookup table.

3. A method according to claim 1, wherein said calibrated relationship is represented by a dim curve.

4. A method according to claim 1, comprising storing said measured power consumption values and said various control voltage values of said calibrated relationship.

5. A method according to claim 4, further comprising analyzing said measured power consumption values as a function of said various control voltage values to establish a dim curve.

6. A method according to claim 5, further comprising analyzing said measured power consumption values to determine a type of said light source.

7. A method according to claim 1, further comprising analyzing said measured power consumption values to determine a warm-up time and/or a life expectancy of said light source.

8. A method according to claim 1, wherein said light source is selected from the group consisting of LED and fluorescent light sources.

9. A method according to claim 1, wherein said control voltage is in a range of 0 to 10 V or in a range of 1 to 10 V.

10. A control unit for a lighting device, said control unit being configured, in a commissioning phase of operation, to receive an input from a dimmer, said input being representative of a desired light output level for said lighting device, and to compute a control voltage for a driver unit comprised in said lighting device, for thereby operating, in an operation phase, a light source used in said lighting device based on said input so as to provide said desired light output level, wherein said computing is at least partly based on an earlier established calibrated relationship between power consumption and control voltage for said lighting device by measuring power consumption values obtained from applying various control voltage values; whereby light output levels are determined that correspond to said various control voltage values.

11. A lighting device comprising a control unit according to claim 10, wherein the driver unit is configured to convert the control voltage into a drive signal for said light source so as to provide said desired light output level, and wherein the lighting device further comprises a power measurement unit configured to measure power consumed by at least one of said light source and said driver unit during operation of the lighting device.

12. A lighting device according to claim 10, with said control unit furthermore being configured to analyze said measured power consumption values as a function of said various control voltage values to establish a dim curve.

13. A lighting device according to claim 10, said lighting device being part of an indoor or outdoor lighting system.

* * * * *